US009682494B2

(12) United States Patent
Arbour

(10) Patent No.: US 9,682,494 B2
(45) Date of Patent: Jun. 20, 2017

(54) COLLOIDAL MIXING METHOD FOR SLURRIES

(71) Applicant: Amix Systems Ltd, Abbotsford (CA)

(72) Inventor: Dennis M. Arbour, Abbotsford (CA)

(73) Assignee: Amix Systems Ltd., Abbotsford, BC (CA)

( * ) Notice: Subject to any disclaimer, the term of this patent is extended or adjusted under 35 U.S.C. 154(b) by 556 days.

(21) Appl. No.: 14/220,750

(22) Filed: Mar. 20, 2014

(65) Prior Publication Data

US 2015/0266206 A1 Sep. 24, 2015

(51) Int. Cl.

| | |
|---|---|
| ***B01F 5/10*** | (2006.01) |
| ***B28C 5/00*** | (2006.01) |
| ***B02C 23/36*** | (2006.01) |
| ***B01F 5/00*** | (2006.01) |
| ***B01F 5/16*** | (2006.01) |
| ***B01F 3/12*** | (2006.01) |
| ***B28C 9/00*** | (2006.01) |
| *B01F 13/10* | (2006.01) |

(52) U.S. Cl.

CPC ..... *B28C 5/006* (2013.01); *B01F 3/1221* (2013.01); *B01F 5/0062* (2013.01); *B01F 5/0065* (2013.01); *B01F 5/104* (2013.01); *B01F 5/16* (2013.01); *B02C 23/36* (2013.01); *B28C 9/004* (2013.01); *B01F 2003/1257* (2013.01); *B01F 2013/1086* (2013.01)

(58) Field of Classification Search

CPC ..... B01F 13/1011; B01F 2013/1077; B01F 2013/1086; B01F 2013/1083; B01F 5/104; B01F 5/16; B01F 3/1221; B01F 5/0065; B01F 5/0062; B01F 2003/1257; B28C 5/006; B28C 9/004; B02C 23/36; B02C 18/08

USPC ..... 366/136–137, 165.1

See application file for complete search history.

(56) References Cited

U.S. PATENT DOCUMENTS

| | | | | | |
|---|---|---|---|---|---|
| 1,781,435 | A * | 11/1930 | Carper | B01F 5/104 | 106/282 |
| 2,277,120 | A * | 3/1942 | Lindsey | A47J 43/04 | 366/137 |
| 2,900,176 | A * | 8/1959 | Krogel | B01F 5/10 | 137/101.27 |
| 2,915,023 | A * | 12/1959 | Rapaport | A23G 1/305 | 118/13 |
| 2,997,373 | A * | 8/1961 | Stephens | B01F 1/0016 | 366/137 |
| 3,172,736 | A * | 3/1965 | Gee et al. | B01F 3/0473 | 134/22.1 |

(Continued)

*Primary Examiner* — Charles Cooley

(74) *Attorney, Agent, or Firm* — Adrian D. Battison; Ade & Company Inc.

(57) ABSTRACT

Colloidal mixing of cementitious material into a liquid such as water to form a grout slurry for pumping to a location for use includes a mixing tank and a colloidal mixing mill which grinds and pumps the mixed material with the material being repeatedly circulated between the mill and the tank. The colloidal mixing mill includes a housing defining a generally cylindrical chamber containing a rotor shaped to define a clearance of the order of 3 mm between the front and rear wall of the housing and the rotor with holes from a dished front face of the rotor to the rear face to carry the mixed materials to the clearance where a shearing action takes place to shear the particles in the mixed materials prior to exit through the outlet.

18 Claims, 8 Drawing Sheets

(56) References Cited

U.S. PATENT DOCUMENTS 3,201,093 A * 8/1965 Smith ..... B01F 5/0057 366/136
3,661,364 A * 5/1972 Lage ..... B01F 5/02 366/136
3,830,473 A * 8/1974 Lieferman ..... C09J 103/00 366/136
3,893,659 A * 7/1975 Krish ..... B01F 5/0057 134/10
3,998,938 A * 12/1976 Szegvari ..... A23G 1/10 241/29
4,299,501 A * 11/1981 Patil ..... A61K 9/107 366/136
4,515,482 A * 5/1985 Schadewald ..... B01F 5/12 366/136
4,621,928 A * 11/1986 Schreiber ..... B01D 21/245 366/137
4,904,089 A * 2/1990 Dunton ..... B01F 3/1221 366/137
4,938,606 A * 7/1990 Kunz ..... B01F 3/0807 123/25 E
5,103,908 A * 4/1992 Allen ..... B01F 3/04836 166/285
5,590,960 A * 1/1997 Clinton ..... B01F 13/10 366/134
5,769,536 A * 6/1998 Kotylak ..... B01F 1/0022 366/136
6,015,225 A * 1/2000 Williams ..... B01F 11/0068 366/114
6,029,853 A * 2/2000 Kubo ..... B01F 7/10 222/1
6,065,860 A * 5/2000 Fuchsbichler ..... B01F 1/0022 366/136
6,109,778 A * 8/2000 Wilmer ..... B01F 3/0857 366/137
6,135,628 A * 10/2000 DeStefano ..... A61K 9/008 261/41.5
6,536,468 B1 * 3/2003 Wilmer ..... B01F 3/0857 137/544
6,971,786 B2 * 12/2005 Krambrock ..... B65G 53/30 366/165.1
7,581,872 B2 * 9/2009 Allen ..... B01F 3/1221 366/134
8,596,857 B2 * 12/2013 Bastesen ..... B01F 3/12 366/136
2009/0000989 A1 * 1/2009 Hassan ..... B01F 3/04099 208/209
2009/0201760 A1 * 8/2009 Vorage ..... B01F 3/0861 366/163.1
2010/0294699 A1 * 11/2010 Hassan ..... B01F 3/04099 208/215
2014/0004367 A1 * 1/2014 Sugiyama ..... B01F 3/1221 428/510
2015/0266206 A1 * 9/2015 Arbour ..... B28C 9/004 241/15
2015/0298076 A1 * 10/2015 Fazekas ..... B01F 5/10 366/132
2015/0299466 A1 * 10/2015 Qiu ..... C08L 91/06 106/498
2016/0271575 A1 * 9/2016 Berger ..... B01F 5/106

* cited by examiner

COLLOIDAL MIXING METHOD FOR SLURRIES

This invention relates to a colloidal mixing method for mixing particulates and liquid into a slurry and for pumping the resultant slurry to a location of use. The arrangement is particularly designed as a stand-alone mixer for cementitious materials and particularly grout but can be used for other granular materials that need a thorough mix.

SUMMARY OF THE INVENTION

According to the invention there is provided a method for colloidal mixing of a particulate material into a liquid to form a slurry comprising:

supplying the particulate material and the liquid to a mixing tank for mixing to form a mixed material;

providing a colloidal mixing mill which grinds and pumps the mixed material;

and communicating the mixed particulate material and the liquid from an outlet of the mixing tank to an inlet of the colloidal mixing mill;

the colloidal mixing mill acting to pump the mixed material back to the mixing tank such that the material is repeatedly circulated between the colloidal mixing mill and the mixing tank;

the colloidal mixing mill comprising;

a housing defining a chamber with a generally cylindrical outer wall surrounding an axis of the chamber, an inlet arranged at one end of the chamber and an outlet in the outer wall;

a rotor mounted in the chamber for rotation about the axis of the chamber so as to carry the mixed materials from the inlet to the outlet so as to pump the mixed materials through the outlet;

the rotor and the housing being shaped to define a clearance between a stationary wall of the housing and a rotating wall of the rotor and to carry the mixed materials to the clearance where a shearing action takes place to shear the particles in the mixed materials prior to exit through the outlet.

Preferably clearances are defined between a rear wall of the chamber and an adjacent rotating rear wall of the rotor and between a front wall of the chamber and a front wall of the rotor.

Preferably the rotor includes a hub at the inlet and a plurality of lobes extending outwardly from the hub to a tip of the lobe adjacent the generally cylindrical outer wall of the housing. Such a shape of hub and lobes is common to generate a pumping action. However other shapes and operation can be provide to generate the pumping action at positions on the rotor spaced or separate from the shearing action of the adjacent walls.

Preferably the rotor includes at least one transfer hole and preferably a series of transfer holes extending through the hub from an inlet end of the hole at a front face of the rotor to receive the mixed materials to an outlet end of the hole at the rear wall of the rotor for the shearing action.

Preferably the hole is inclined rearwardly and outwardly from the inlet end at the inlet through the rear wall where the shearing action takes place. However where the shearing action takes place at a different wall of the rotor, the arrangement of the transfer holes may be of a different shape and location.

Preferably the rotor has the front face at the inlet of the housing containing the inlet ends of the transfer holes which forms a concave dish.

Typically the rotor runs at speed from 1200 to 2200 rpm.

Typically the clearance between the wall of the rotor and the wall of the chamber is less than 10 mm and more preferably in smaller models of the order of 3 mm and on larger models in the order of 8 to 10 mm.

Preferably the colloidal mixing mill acts as a pump to transfer the mixed materials to a required location.

Preferably the mixing tank comprises a vertical cylindrical tank body with tangential inlets at an outer peripheral wall of the tank and a central injecting nozzle. However other shapes and arrangements are possible where the recirculating action causes the returning material from the pump to be mixed again on a larger scale within the mixing tank to ensure that the material exiting the mixing tank carries all of the material.

Preferably the mixing tank is shaped so that heavier mixed materials are circulated towards the peripheral wall by tangential inlets.

Preferably the mixing tank is shaped to define a center vortex directing the mixed materials to a bottom discharge to pass to the colloidal mill.

Preferably the colloidal mixing mill has more than one outlet with the mixed materials from the outlets being returned to the mixing tank at different locations thereon to promote mixing within the mixing tank.

Preferably the high velocity rotor inside the chamber does the shearing of the cementitious particles breaking them down to their individual form.

Preferably the shearing of the particles is arranged for enabling complete contact between the particles and wetting by mixing water to ensure that every particle is hydrated.

Preferably the shearing takes place between a wall of the chamber and a side edge of a leading face of the rotor.

The arrangement provided herein and described in detail hereinafter comprises a high-shear colloidal mixer of a high efficiency kind that is effective for larger automated grout plants and systems. The arrangement can be used as a stand-alone mixer for cementitious materials or other granular materials that need a thorough mix.

The high-shear colloidal mill or pump itself is the significant component of the colloidal mixer. The rotor or impeller within the pump runs at speed from 1200 to 2200 rpm and is located only 3 mm from the walls of the inner housing where the turbulence and shearing action takes place. In addition to mixing it can also serve as a pump to transfer the grout/slurry to various locations, for example to agitation tanks or to a spray bar assembly.

Acting as a centrifugal separator, the colloidal mixer circulates heavier grout towards the outside via tangential entries of the mixing tank to mix with the lighter grout and then pushed through the center vortex towards the colloidal mill. Once through the mixer the process is then repeated over until multiple passes are made and until the entire mix becomes uniform with no agglomerates and homogenous with the centrifugal action so as to no longer contain separating differing densities.

The high velocity rotor or impeller inside the mill does the shearing of the cementitious particles breaking them down to their individual form and enabling complete contact between the particles and wetting by mixing water. This insures that every particle is hydrated for maximum strength and durability.

This process can contribute to a cost savings of up to 55% depending on the mix design and application compared to other types of mixers from the shearing effect of the colloidal mill.

Not all colloidal mills and mixers are equal. Many will plug in the trap/mill area or in the piping easily when the mixers are large and or when the water/cement ratios are low. Many cannot do larger batches under these conditions, cannot stand up to the punishment of 24 hour a day operation or have easy reliable mixer/system cleaning. The present arrangement overcomes these common problems through design and operation.

The arrangement as described in more detail hereinafter can provide one or more of the following advantages:

Near perfect reliability and availability.

easy cleaning

Minimize cavitation and plugging.

Larger batches with lower water/cement ratios (thicker mix).

Consistent, uniform and stable mix for increased pumping distances and even slurry.

Sizes from 250 L (132 USG) to 4000 L (1,058 USG) batch capacity or larger.

The colloidal mill is a combination of the best technologies available.

The arrangement can be used from small to large automated grout plants that can produce high quality grouts with a higher output with near perfect reliability.

The arrangement is a reliable, simple design, easy to maintain with few moving parts and easy to operate.

The arrangement is self-cleaning.

The arrangement uses an slurry pump bearing drive which is a cartridge type design.

The grout seal is of proven slurry pump design utilizing grease purge packing and or mechanical seals which is coupled to the wetted parts of the mill that insure reliability and performance.

The arrangement uses wetted parts of the mill that are a configuration recognized as the leader in mill technology, to insure good mixing and shearing of the cementitious materials.

The arrangement has higher shear and flow rates to ensure high performance, reliability, ease of repair and minimum down time.

The arrangement provides a colloidal mill which has large feed inlet into the housing of the mill. This prevents cavitation and plugging of the mill that results in the ability of the mixer to use lower water/cement ratios (thicker mix) than other arrangements.

The arrangement can handle larger batches with lower water/cement ratios (thicker mix) than other arrangements. The reason for this is that the ACM mill has been designed for such an application and will shear a much higher volume/minute than other manufactures.

The arrangement works well in unattended automated plants and/or with simple manual plants.

The arrangement provides consistent uniform and stable mix which allows for increased pumping distances which also contributes to the slurry penetrating evenly into voids.

The arrangement uses less cement to give equal strengths compared to paddle type mixers. This will result in cost savings of up to 55% depending on the mix design and application of grout.

The arrangement provides a grout which can be immersed in water, resisting washout or contamination with external water sources.

The arrangement provides a mixed grout which resists grout bleed.

The arrangement is a compact, modular design for ease of transport, plant setup and site security.

The colloidal mill can be incorporated on a typical paddle mixer to enhance performance of the paddle mixer.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
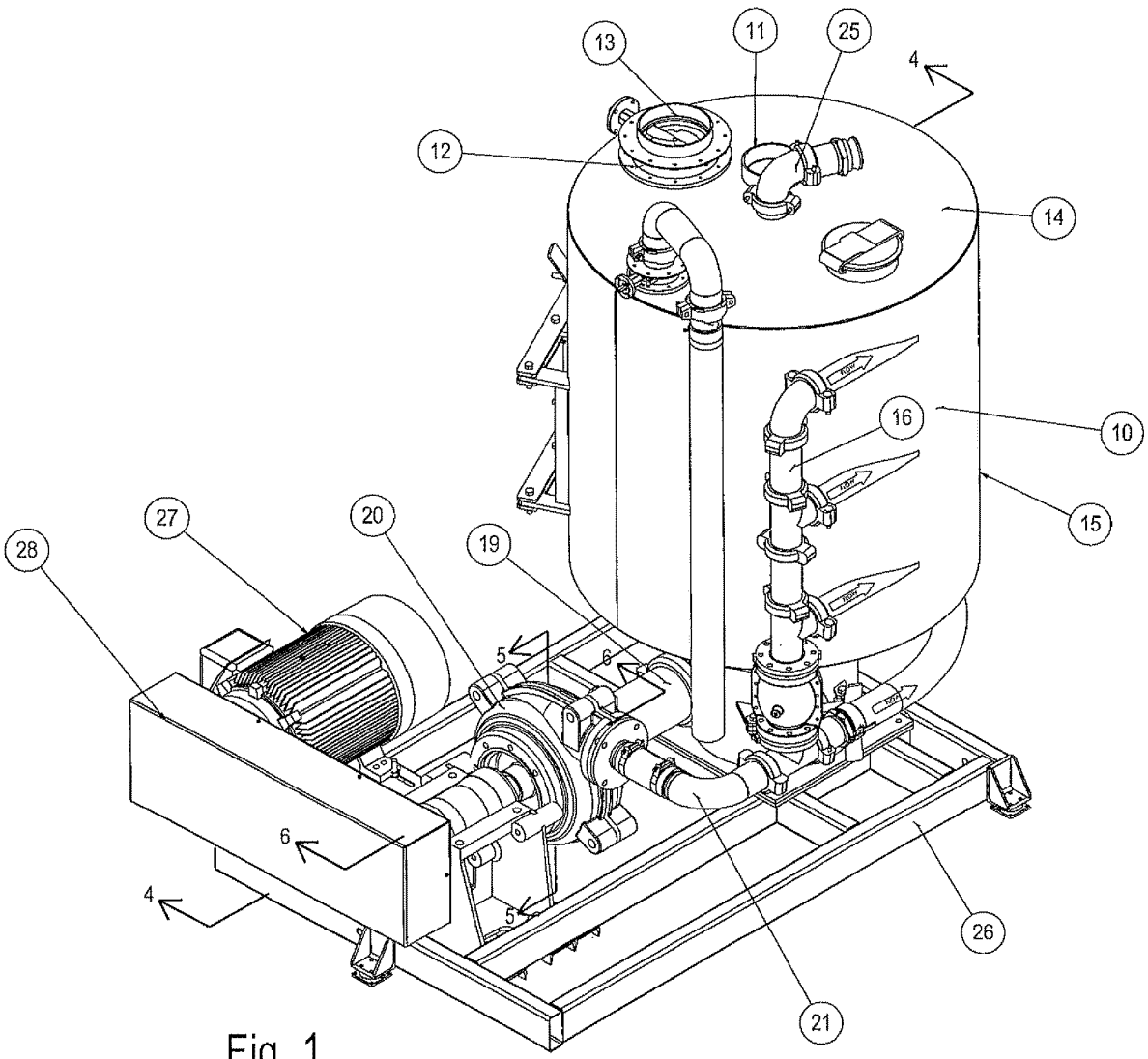
FIG. 1 is a first isometric view of a mixing apparatus for carrying out a method according to the present invention.
Figure 2:
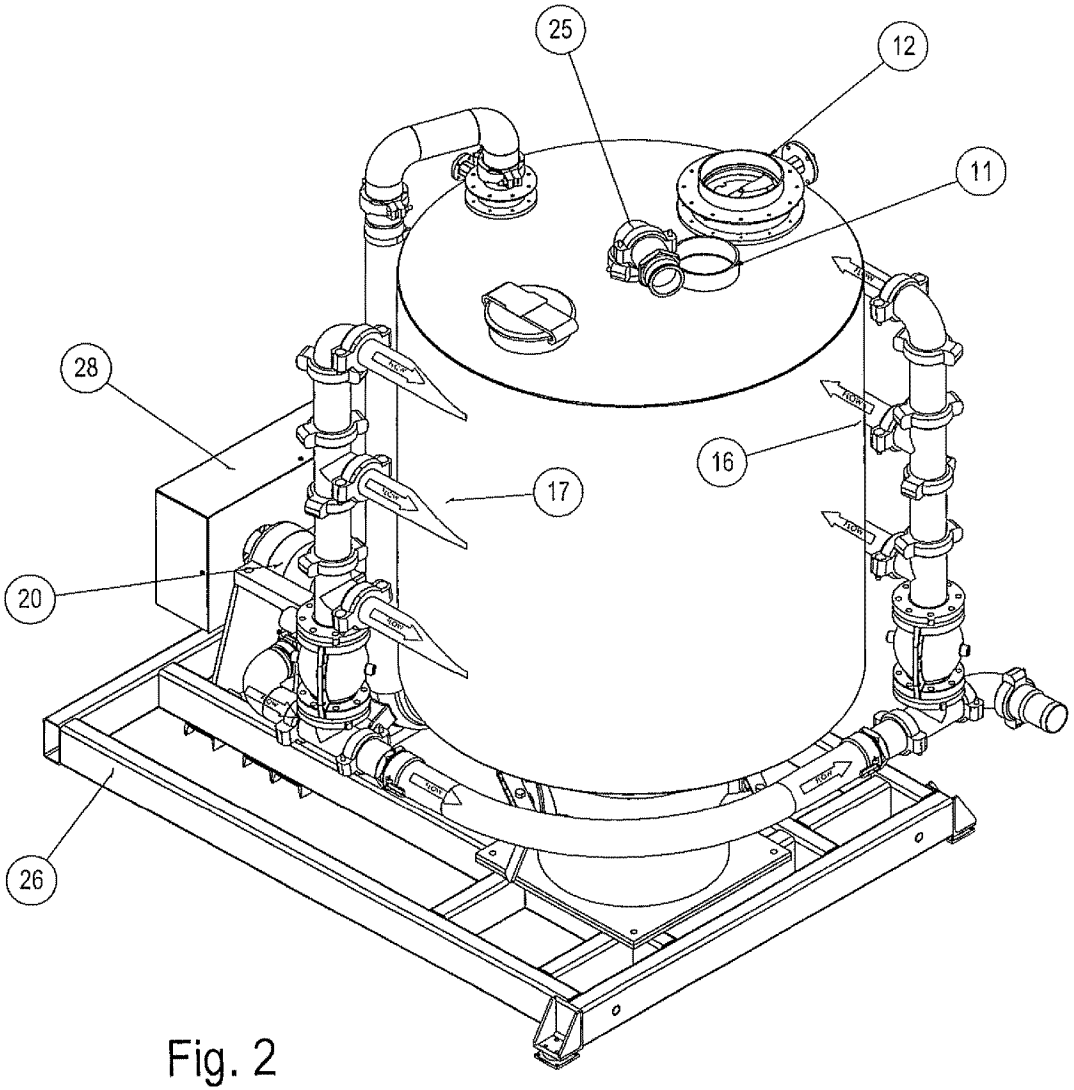
FIG. 2 is a second isometric view of a mixing apparatus for carrying out a method according to the present invention.

The apparatus shown in the figures is used in a method for colloidal mixing of a particulate material into a liquid to form a slurry.

The apparatus includes a mixing tank 10 for mixing to form a mixed material which includes in a top wall 14 a water inlet pipe 11 and an opening 12 with a cover 13 for feeding particulate material. The tank has a cylindrical peripheral wall 15 with two sets of tangential inlet jets 16 and 17 where each includes three jets stacked along the height of the wall 15. A bottom discharge 18 in a bottom wall of the tank is arranged to supply the mixed materials from the bottom of the tank through a pipe 19 to a colloidal mixing mill 20 which grinds and pumps the mixed material.

The colloidal mixing mill 20 acts to pump the mixed material back to the to the mixing tank 10 through a return pipe and the jets 16, 17 such that the material is repeatedly circulated between the colloidal mixing mill 20 and the mixing tank 10.

Figure 3:
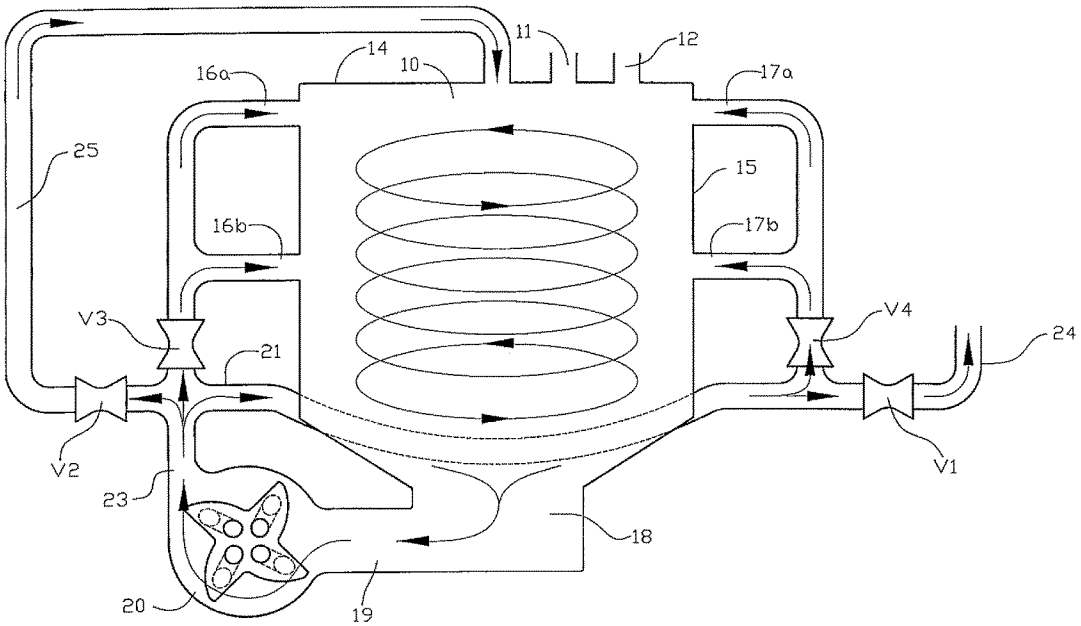
FIG. 3 is a schematic illustration of the method of the FIGS. 1 and 2.
Figure 4:
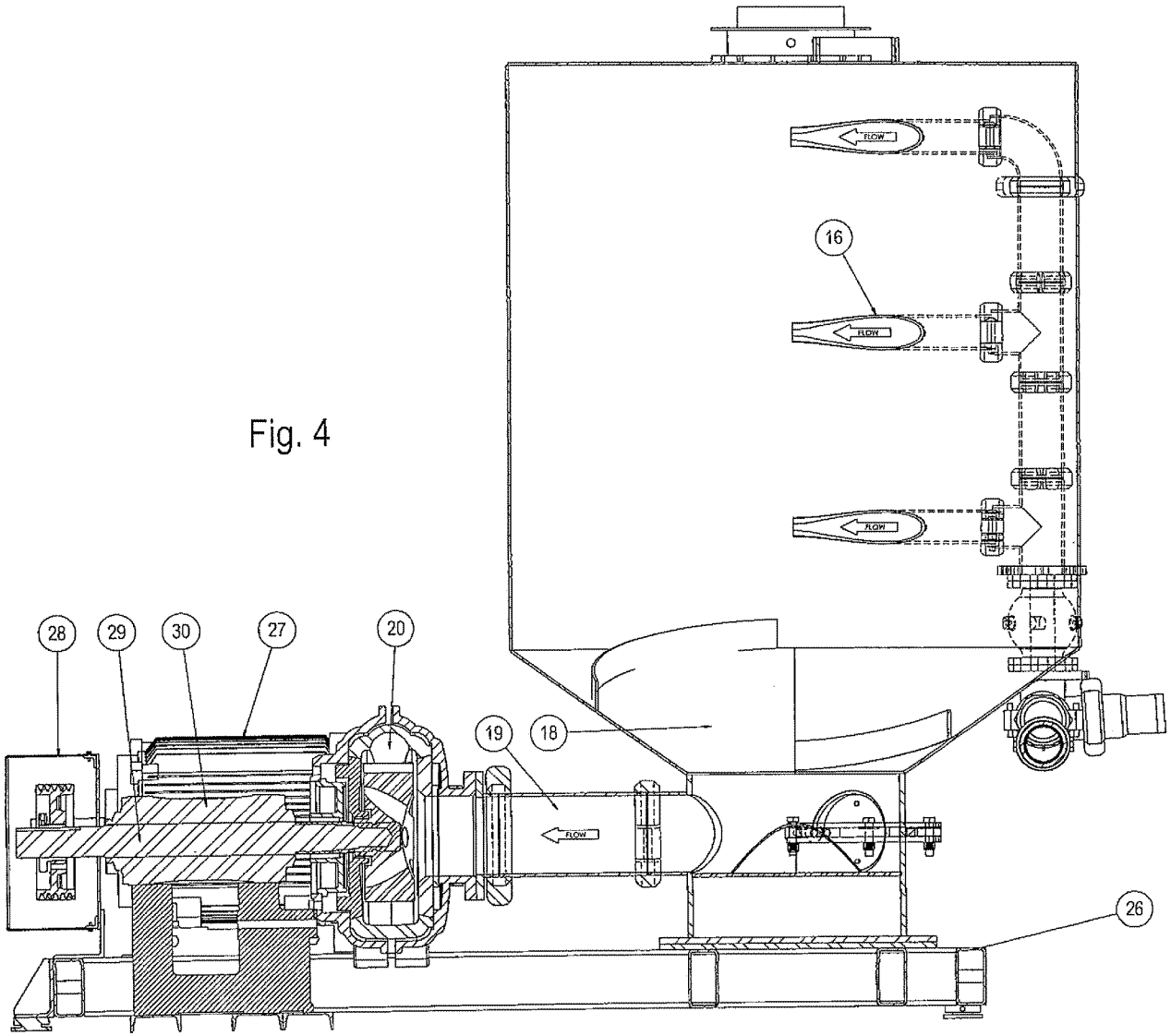
FIG. 4 is a cross-sectional view along the lines 4-4 of FIG. 1.
Figure 5:
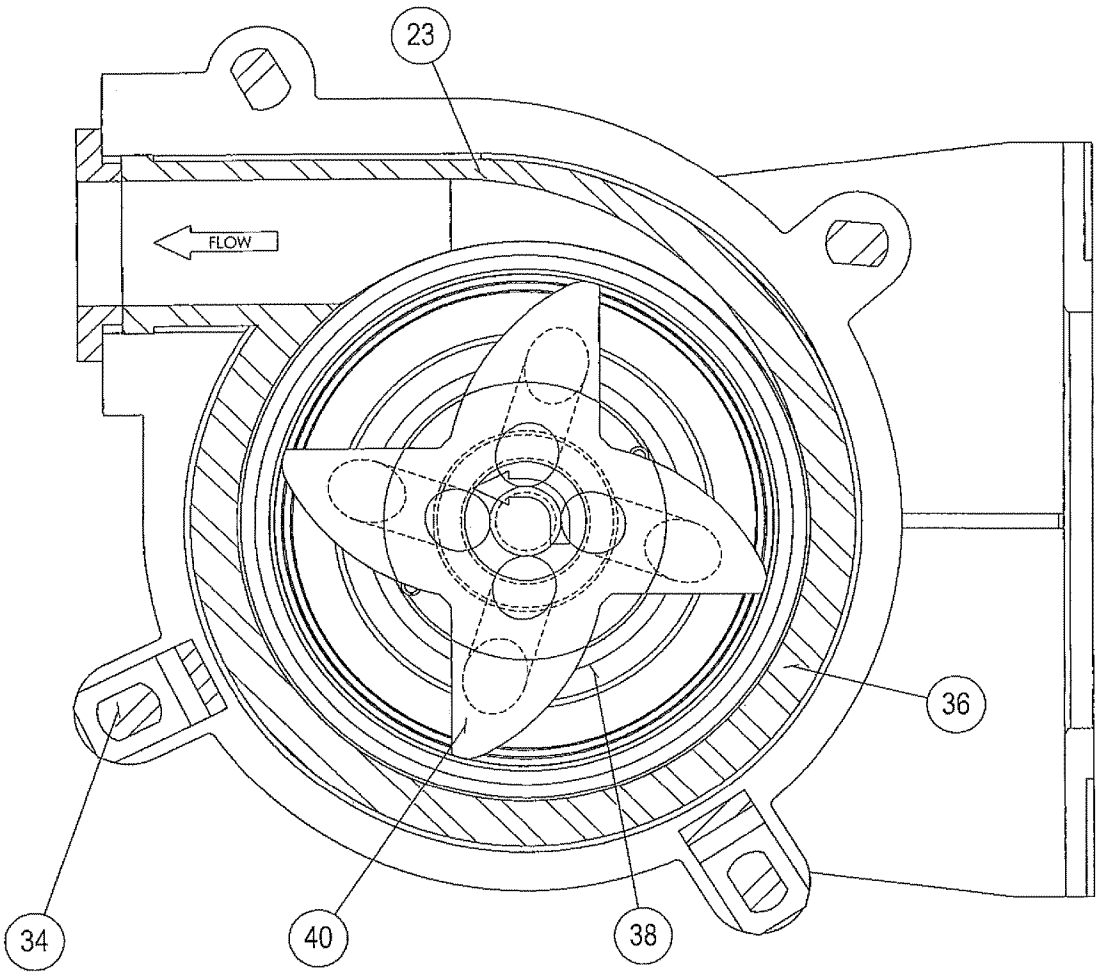
FIG. 5 is a cross-sectional view along the lines 5-5 of FIG. 1.
Figure 6:
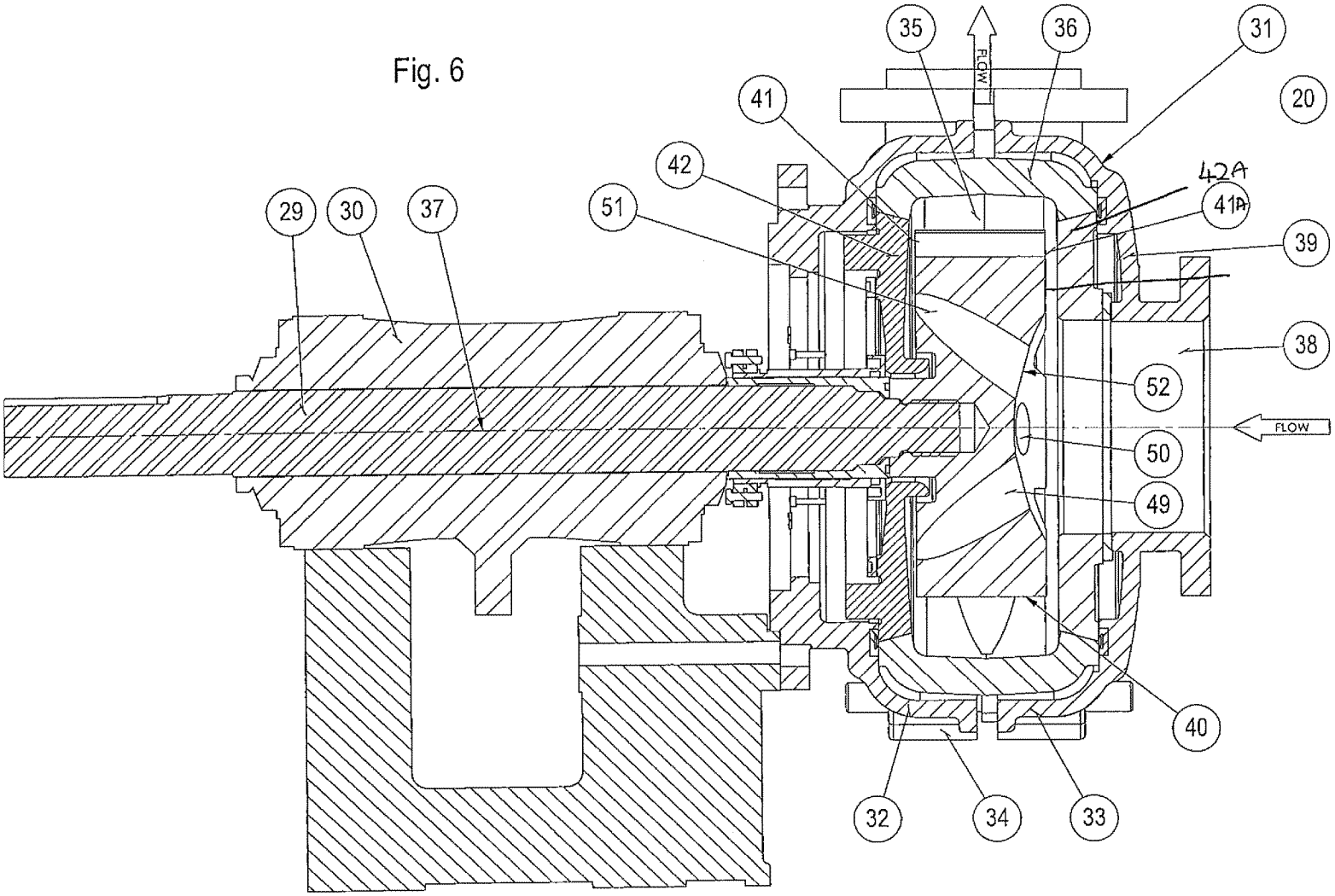
FIG. 6 is a cross-sectional view along the lines 6-6 of FIG. 1.
Figure 7:
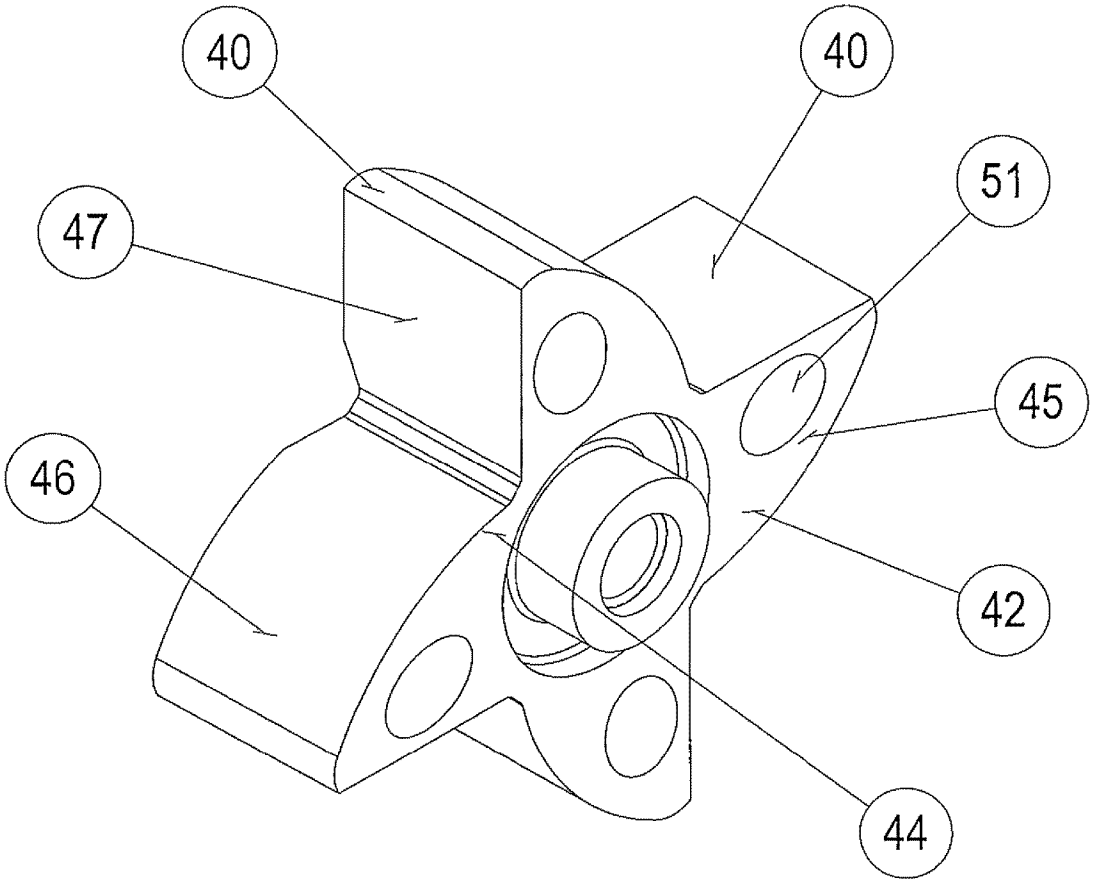
FIGS. 7 and 8 are isometric views of the rotor alone from the apparatus of FIG. 1
Figure 8:
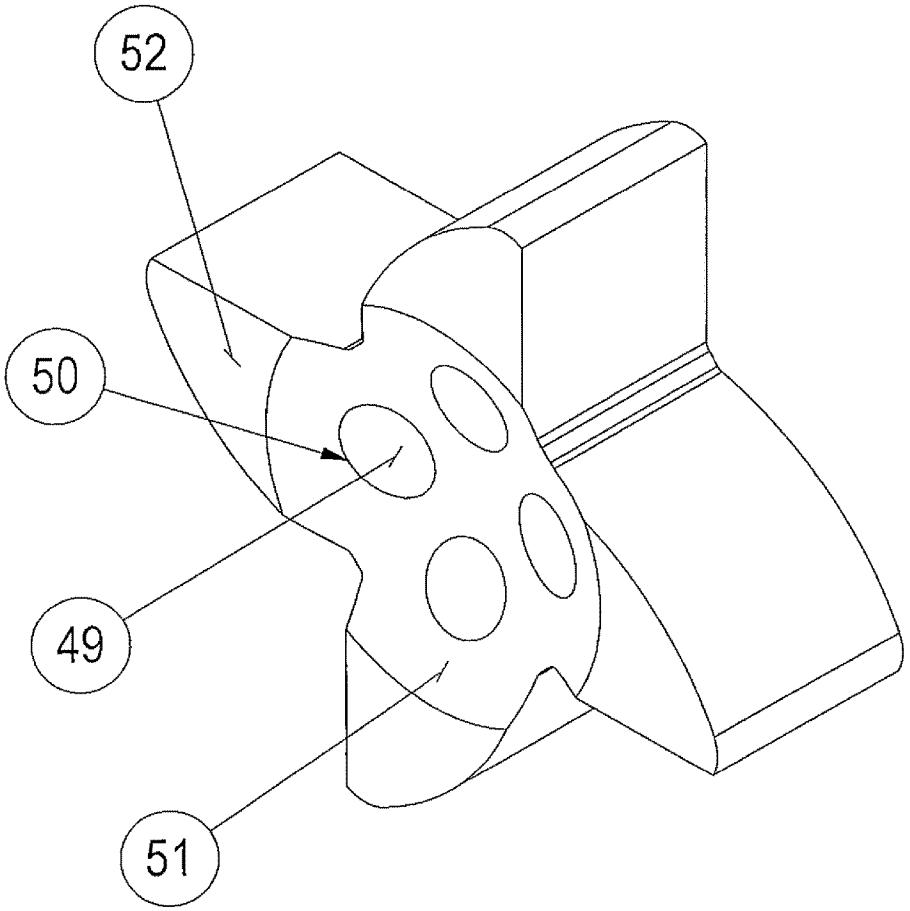

As shown in FIG. 3, the mixing mill 20 has tangential outlet 23. The outlet 23 feeds pipe 21 through control valves V3 & V4. It also feeds an outlet discharge pipe 24 controlled by a valve V1 which can direct the material when fully mixed to an end use location at the end of the pipe 24. The outlet 23 also can supply the mixed material from the mill 20 back to the tank through a central feed pipe 25 through the top of the tank and along a center axis of the tank 10.

The whole system sits on a transport base frame 26 which also carries a motor 27 which drives the mill 20 through a belt drive 28 and a shaft 29 carried on bearings 30.

The colloidal mixing mill 20 includes a housing 31 formed by a rear portion 32, through which the shaft 29 passes, and a front portion 33 clamped together by bolts 34. The housing defines a chamber 35 with a generally cylindrical outer wall 36 surrounding an axis 37 of the chamber. An inlet 38 is arranged at one end of the chamber in a front wall 39. A tangential outlet 23 is provided in the cylindrical outer wall so that the mill 20 can act as a conventional pump where the material entering the inlet 38 is carried around the cylindrical wall by a rotor 40 carried on the shaft 29.

The rotor 40 mounted in the chamber 35 for rotation about the axis 37 of the chamber so as to carry the mixed materials from the inlet 38 to the outlet 23 so as to pump the mixed materials through the outlet.

The rotor 40 and the housing 31 are shaped to define clearances 41 and 41A between a flat stationary rear wall 42 of the housing and a flat rotating rear wall of the rotor 40 and between a flat stationary front wall 42A of the housing and a flat rotating front wall of the rotor 40 wherein both clearances a shearing action takes place to shear the particles in the mixed materials prior to exit through the outlet 23.

Thus the clearances are defined between the rear and front walls 42 of the chamber opposite the inlet and the adjacent rotating rear wall of the rotor including a hub portion 44 and four lobes 45 of the rotor, both of which have a surface lying in the same flat rear plane of the rotor. The lobes 45 are shaped with leading edge 46 and trailing edge 47 which act to carry the mixed materials from the inlet outwardly to the outer wall to a tip 48 of the lobe adjacent the generally cylindrical outer wall of the housing to eject the material through the outlet extending outwardly from the hub. The shearing action primarily takes place between the side edges of the leading surface 46 at the front and rear walls as the lobes rotate.

The rotor also includes four transfer holes 49 each aligned with a respective lobe and each extending through the hub from an inlet end 50 of the hole at the front face 52 of the rotor to receive the mixed materials therefrom to an outlet end 51 of the hole 49 at the rear wall 42 of the rotor. The holes 49 are inclined rearwardly and outwardly from the inlet end 50 thereof to the rear end 51 so that the rotation of the rotor tends to drive the material through the hole 49 to the rear wall of the rotor.

The front face of the rotor facing the inlet forms a concave dish 51 within which the inlet ends 50 of the holes 49 are located. The outlet ends are spaced outwardly from the hub aligned with the concave dish so as to be located in the rear face of the respective lobe.

Thus the concave dish 51 in the front face of the rotor is recessed from the plane containing the front face 52 of the housing so that the mixed materials entering the inlet 38 can enter into this recessed dish area and can then pass either through the holes to the rear wall of the housing or around the outside edge of the dished area to the front face of the housing. In both areas at the front and rear the shearing action takes place between the lobes and the walls of the housing.

After refilling of water in the mixer the water is then recirculated through the mixer and grout lines returning into the mixer and spraying the inside and cleaning residue left over from the last batch. This dirty water is then used in the next batch. This process also reduces the amount of waste-water that is used in the process of cleaning the system.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed:

1. A method for colloidal mixing of a particulate material containing particles into a liquid to form a slurry comprising:

supplying the particulate material and the liquid to a mixing tank for mixing to form a mixed material;

providing a colloidal mixing mill which grinds and pumps the mixed material;

and communicating the mixed material containing the particulate material and the liquid from an outlet of the mixing tank to an inlet of the colloidal mixing mill;

the colloidal mixing mill acting to pump the mixed material back to the to the mixing tank such that the mixed material is repeatedly circulated between the colloidal mixing mill and the mixing tank;

the colloidal mixing mill comprising;

a housing defining a chamber with a generally cylindrical outer wall surrounding an axis of the chamber, a front wall and a rear wall;

an inlet arranged in the front wall of the chamber and an outlet in the outer wall;

a rotor mounted in the chamber for rotation about the axis of the chamber having a front face of the rotor at the front wall of the chamber and a rear face of the rotor at the rear wall of the housing;

the rotor comprising a hub at the axis of the chamber and a plurality of angularly spaced lobes each extending from the hub outwardly of the axis to an outer tip adjacent the outer wall so that rotation of the hub acts so as to carry the mixed material from the inlet to the outlet and to pump the mixed material through the outlet;

the rotor and the housing being shaped to define a clearance between the rear wall of the housing and the rear face of the rotor;

and providing a plurality of holes at angularly spaced positions around the axis through the rotor from the front face of the rotor to the rear face of the rotor to carry the mixed material to the clearance at the rear face of the rotor where a shearing action takes place to shear the particles in the mixed material prior to exit through the outlet.

2. The method according to claim 1 wherein a further clearance is defined between the front wall of the chamber and the front face of the rotor.

3. The method according to claim 1 wherein said holes are inclined rearwardly from an inlet end of said holes at said front face of the rotor to said rear face and are inclined outwardly from the axis.

4. The method according to claim 1 wherein the front face of the rotor at the inlet forms a concave dish.

5. The method according to claim 1 wherein the rotor runs at speed from 1200 to 2200rpm.

6. The method according to claim 1 wherein the clearance between the lobes of the rotor and the outer wall of the chamber is less than 5mm.

7. The method according to claim 1 wherein the clearance between the lobes of the rotor and the outer wall of the chamber is of the order of 3mm.

8. The method according to claim 1 wherein the colloidal mixing mill acts as a pump to transfer the mixed material to a required location.

9. The method according to claim 1 wherein:

each of the lobes has a rear face adjacent the rear wall of the chamber;

each of the lobes has a leading face with a side edge of the leading face at the rear wall of the chamber and a trailing face with a side edge of the leading face at the rear wall of the chamber;

the rotor and the housing being shaped to define said clearance between the rear wall and the rear face of the lobes; and the shearing action takes place between the rear wall of the chamber and said side edge of said leading face of the lobes of the rotor.

10. The method according to claim 9 wherein the holes exit respective ones of the rear faces of the lobes.

11. A method for colloidal mixing of a particulate material into a liquid to form a slurry comprising:

supplying the particulate material containing particles and the liquid to a mixing tank for mixing to form a mixed material;

providing a colloidal mixing mill which grinds and pumps the mixed material;

and communicating the mixed material containing the particulate material and the liquid from an outlet of the mixing tank to an inlet of the colloidal mixing mill;

the colloidal mixing mill acting to pump the mixed material back to the to the mixing tank such that the mixed material is repeatedly circulated between the colloidal mixing mill and the mixing tank;

the colloidal mixing mill comprising;

a housing defining a chamber with a generally cylindrical outer wall surrounding an axis of the chamber, a front wall and a rear wall;

an inlet arranged in the front wall of the chamber and an outlet in the outer wall;

a rotor mounted in the chamber for rotation about the axis of the chamber having a front face of the rotor at the front wall of the chamber and a rear face of the rotor at the rear wall of the housing;

the rotor comprising a hub at the axis of the chamber and a plurality of angularly spaced lobes each extending from the hub outwardly of the axis to an outer tip adjacent the outer wall so that rotation of the hub acts so as to carry the mixed material from the inlet to the outlet and to pump the mixed material through the outlet;

the rotor and the housing being shaped to define a clearance between the rear wall of the housing and the rear face of the rotor;

and providing at least one hole through the rotor from the front face of the rotor to the rear face of the rotor to carry the mixed material to the clearance at the rear face of the rotor where a shearing action takes place to shear the particles in the mixed material prior to exit through the outlet;

wherein said at least one hole is inclined rearwardly from an inlet end of said at least one hole at said front face of the rotor to said rear face and is inclined outwardly from the axis.

12. The method according to claim 11 wherein said at least one hole comprises a plurality of holes where the holes each exit respective ones of rear faces of the lobes at the rear face of the rotor.

13. A method for colloidal mixing of a particulate material containing particles into a liquid to form a slurry comprising:

supplying the particulate material and the liquid to a mixing tank for mixing to form a mixed material;

providing a colloidal mixing mill which grinds and pumps the mixed material;

and communicating the mixed material containing the particulate material and the liquid from an outlet of the mixing tank to an inlet of the colloidal mixing mill;

the colloidal mixing mill acting to pump the mixed material back to the to the mixing tank such that the mixed material is repeatedly circulated between the colloidal mixing mill and the mixing tank;

the colloidal mixing mill comprising;

a housing defining a chamber with a generally cylindrical outer wall surrounding an axis of the chamber, a front wall and a rear wall;

an inlet arranged in the front wall of the chamber and an outlet in the outer wall;

a rotor mounted in the chamber for rotation about the axis of the chamber having a front face of the rotor at the front wall of the chamber and a rear face of the rotor at the rear wall of the housing;

the rotor comprising a hub at the axis of the chamber and a plurality of angularly spaced lobes each extending from the hub outwardly of the axis to an outer tip adjacent the outer wall so that rotation of the hub acts so as to carry the mixed material from the inlet to the outlet and to pump the mixed material through the outlet;

the rotor and the housing being shaped to define a clearance between the rear wall of the housing and the rear face of the rotor;

and providing at least one hole through the rotor from the front face of the rotor to the rear face of the rotor to carry the mixed material to the clearance at the rear face of the rotor where a shearing action takes place to shear the particles in the mixed material prior to exit through the outlet;

wherein the front face of the rotor at the inlet forms a concave dish.

14. The method according to claim 13 wherein said at least one hole is inclined rearwardly from an inlet end of said at least one hole at said front face of the rotor to said rear face and is inclined outwardly from the axis.

15. The method according to claim 13 wherein said at least one hole comprises a plurality of holes where the holes each exit respective ones of rear faces of the lobes at the rear face of the rotor.

16. A method for colloidal mixing of a particulate material containing particles into a liquid to form a slurry comprising:

supplying the particulate material and the liquid to a mixing tank for mixing to form a mixed material;

providing a colloidal mixing mill which grinds and pumps the mixed material;

and communicating the mixed material containing the particulate material and the liquid from an outlet of the mixing tank to an inlet of the colloidal mixing mill;

the colloidal mixing mill acting to pump the mixed material back to the to the mixing tank such that the mixed material is repeatedly circulated between the colloidal mixing mill and the mixing tank;

the colloidal mixing mill comprising;

a housing defining a chamber with a generally cylindrical outer wall surrounding an axis of the chamber, a front wall and a rear wall;

an inlet arranged in the front wall of the chamber and an outlet in the outer wall;

a rotor mounted in the chamber for rotation about the axis of the chamber having a front face of the rotor at the front wall of the chamber and a rear face of the rotor at the rear wall of the housing;

the rotor comprising a hub at the axis of the chamber and a plurality of angularly spaced lobes each extending from the hub outwardly of the axis to an outer tip adjacent the outer wall so that rotation of the hub acts so as to carry the mixed material from the inlet to the outlet and to pump the mixed material through the outlet;

each of the lobes having a rear face adjacent the rear wall of the chamber;

each of the lobes having a leading face with a side edge of the leading face at the rear wall of the chamber and a trailing face with a side edge of the leading face at the rear wall of the chamber;

the rotor and the housing being shaped to define a clearance between the rear wall of the housing and the rear face of the rotor including the rear face of the lobes;

and providing at least one hole through the rotor from the front face of the rotor to the rear face of the rotor to carry the mixed material to the clearance at the rear face of the rotor where a shearing action takes place to shear the particles in the mixed material prior to exit through the outlet;

wherein the shearing action takes place between the rear wall of the chamber and said side edge of said leading face of the lobes of the rotor.

17. The method according to claim 16 wherein said at least one hole is inclined rearwardly from an inlet end of said at least one hole at said front face of the rotor to said rear face and is inclined outwardly from the axis.

18. The method according to claim 16 wherein said at least one hole comprises a plurality of holes where the holes each exit respective ones of the rear faces of the lobes at the rear face of the rotor.

* * * * *